United States Patent [19]

Weber et al.

[11] Patent Number: 4,979,335

[45] Date of Patent: Dec. 25, 1990

[54] APPARATUS FOR PRECISION MACHINING CRANK PINS OF CRANKSHAFTS

[75] Inventors: Gottried Weber, Cologne; Otto Godderz, Bad Munstereifel, both of Fed. Rep. of Germany

[73] Assignee: Ford Motor Company, Dearborn, Mich.

[21] Appl. No.: 340,972

[22] Filed: Apr. 20, 1989

[30] Foreign Application Priority Data

Apr. 21, 1988 [DE] Fed. Rep. of Germany ..... 3813484

[51] Int. Cl.[5] ..... B24B 21/00

[52] U.S. Cl. ..... 51/137; 51/145 R; 51/161

[58] Field of Search ..... 51/135 R, 137, 141, 51/145 R, 149, 156, 236, 237 CS, 238 CS, 237, 394, 407, 150, 154, 155; 81/57.17

[56] References Cited

U.S. PATENT DOCUMENTS

| | | | |
|---|---|---|---|
| 3,537,215 | 11/1970 | Metz et al. | 51/237 CS |
| 4,063,542 | 12/1977 | Uemura | 51/59 SS |
| 4,204,515 | 5/1980 | Seifert et al. | 51/59 R |
| 4,747,234 | 5/1988 | Weber | 51/238 S |

FOREIGN PATENT DOCUMENTS 3440350 5/1984 Fed. Rep. of Germany .

*Primary Examiner*—Frederick R. Schmidt
*Assistant Examiner*—M. Morris
*Attorney, Agent, or Firm*—Joseph W. Malleck; Roger L. May

[57] ABSTRACT

An apparatus for precision machining the crank pins of crankshafts by means of non-rotating tools, one bearing part of each tool formed by a half-shell constructed resiliently or supported resiliently with respect to the radially oriented force of an associated displacement cylinder which is articulated with respect to the bearing part.

9 Claims, 1 Drawing Sheet

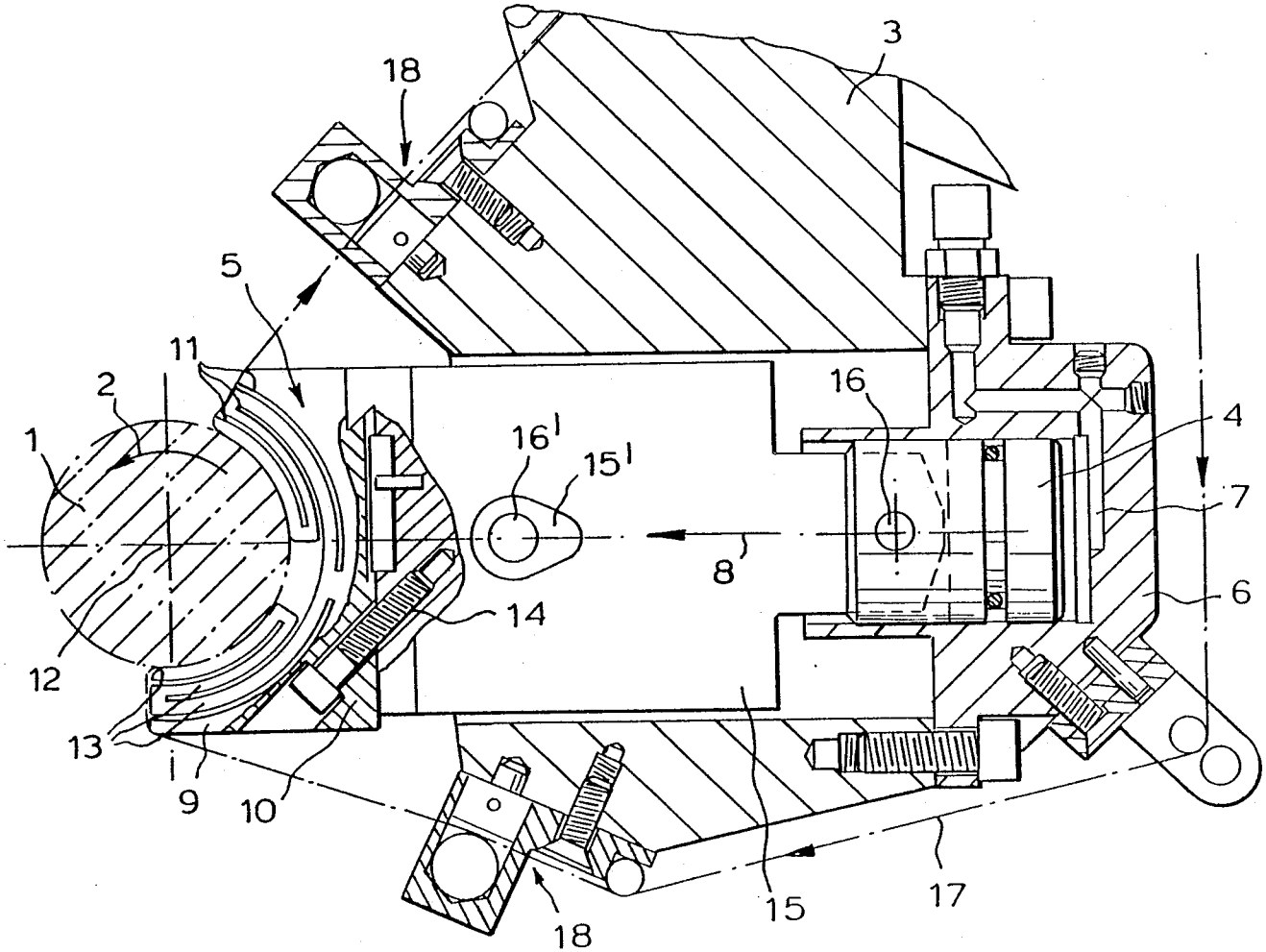
1
2
3
4
5
6
7
8
9
10
11
12
13
14
15
15'
16
16'
17
18
18

APPARATUS FOR PRECISION MACHINING CRANK PINS OF CRANKSHAFTS

BACKGROUND OF THE INVENTION

1. Technical Field

The invention relates to art of precision machining crank pins of crankshafts for internal combustion engines and, more particularly, to such machining carried out by rotating the crankshaft with its pins in machining contact with tools that are substantially non-rotating with respect to the pin axis.

2. Description of the Prior Art

In the case of a previously employed apparatus of this type, tools are used which have a bearing portion which presents a dimensionally stable arcuate surface or half-shell and is often rotationally movable with respect to a displacement cylinder associated therewith. The bearing portions are arranged on a plurality of supports or guide shoes spaced apart from one another in the peripheral direction of the surface of the shell. The bearing portion may preferably consist of plastic material in the form of a honing belt. The honing belt permits precision machining of the associated crank pin of a workpiece and has the potential to increase the bearing portion and facilitate the rounding of the edges of lubricating oil bores already formed in rough-machined crank pins.

For this type of apparatus, an alternative use of tools is also known in which, instead of working with a honing belt, the precision machining of the crank pins is carried out with one or more honing stones in a manner according to the apparatus disclosed in German Patent No. 30 08 606. In this latter patent, bearing portions are solid, non-resilient stones supported on and moved by special support and guide shoes against the associated crank pin, the bearing portion being made in the form of half-shells.

The use of guide shoes supported resiliently on tong-like guide arms determining the positioning of honing stones, carried at a different circumferential location on the tong-like guide arms, is known from German Offenlegungsschrift (Laid-Open Specification) No. 34 40 350. The honing stones are pressed against the respective crank pin by displacement cylinders which are provided in addition to an operating cylinder closing the guide arms relative to the workpiece in the manner of tongs.

SUMMARY OF THE INVENTION

The object of constructing an apparatus of the type in said prior art patents is attained by the invention, but in such a new way that a further increase in the bearing or supporting portion for the individual crank pin machining surface is achieved and the circularity errors, still noticeable to a microscopic degree in the case of previous precision machining, are largely overcome.

The advantages achievable with the apparatus according to the invention reside (i) in its being incorporated in a simple manner in the former machining process of crank pins for crankshafts as a machining stage which can either precede or follow the previous final stage, and (ii) in the use of tool bearing surfaces that are radially resilient in a plurality of peripheral locations of the crank pin. Since the tools are arranged in a "breathing" or articulated manner with respect to the associated crank pins of the workpieces as a result of the resilient design or support of their bearing parts, the guidance of the tools transmitted by the guide arms through the two master shafts of the apparatus is thus used for machining as true to shape as possible, so that with this apparatus it is possible to eliminate, to a correspondingly optimum degree, all the machining defects which have been heretofore detected to a microscopic degree in the surface quality after the final stage of the former precision machining.

The invention is a tool guide arm apparatus for precision machining of a crank pin of a crankshaft, said apparatus being supported for synchronous movement with the axis of such crank pin but with little or no relative rotation about the pin axis, said apparatus comprising: (a) a guide arm having means to apply a pressure medium; (b) a tool holder carried by said guide arm and displaceable radially, with respect to the axis of said crank pin, when acted upon by said pressure medium; and (c) a tool supported by said holder to engage said crank pin, said tool having a bearing portion adapted to bear against an arcuate side of said crank pin, said portion being resilient to the displacement force of said holder and extending resiliently over an arc of said crank pin of 135°–180°.

SUMMARY OF THE DRAWINGS

FIG. 1 is a sectional view of only part of a guide arm for a tool having a design in accordance with this invention.

DETAILED DESCRIPTION AND BEST MODE

An apparatus for precision machining the crank pins of crankshafts by means of tools, substantially non-rotatable with respect to the crank pin axis, is formed according to a previously used embodiment with two master shafts which are arranged axially parallel with the workpiece to be machined and are driven synchronously with the workpiece. A plurality of tools corresponding to the crank pins of the workpieces are guided in a duplicated manner through the master shafts, the guidance of the tools being transmitted by guide arms which are also carriers of displacement cylinders which are acted upon with pressure medium and by which the respectively associated tool is mounted radially displaceably with respect to the associated crank pins. Precision machining of the crank pins is conventionally carried out either with honing stones or with honing belts, which are thus pressed against the crank pins by the displacement cylinders during machining.

FIG. 1 shows a cross-section through a crank pin 1 of a crankshaft which, as a workpiece to be machined, is driven synchronously with the two master shafts (not shown) of the apparatus in the anti-clockwise direction in accordance with the arrow 2 indicated. The two master shafts have connected to them a guide arm 3 guided in a duplicated manner and on which is mounted a displacement cylinder 4 which is acted upon by a pressure medium and by which a tool 5, provided for precision machining the crank pin 1, can be pressed in the radial direction against the surface of the crank pin. The pressure medium is supplied to the displacement cylinder 4 by way of an operating part 6, flanged onto the guide arm 3, of an hydraulic or pneumatic control apparatus, the design of which is of interest only inasmuch as a displacement force acting in the direction of the arrow 8 is provided for the displacement cylinder 4 by a supply line for the pressure medium into a filling chamber 7 of the operating part 6. This displacement force, acting in the direction of the arrow 8, is thus transmitted to the tool 5 which is guided in a duplicated manner by the guide arm through the two master shafts and bears on one side of the crank pin 1.

The tool 5 is formed by a half-shell 9 (bearing portion), which is made resilient with respect to the force of the displacement cylinder 4, and a base member 10 of spring steel integrally joined thereto. The resilient construction of the half-shell 9 is provided by individual annular gaps 11, having mutually overlapping design in the peripheral direction, extend concentrically to the axis 12 of the half-shell 9, which axis coincides with the crank pin 1 axis. On account of the annular gaps 11, the otherwise solidly constructed base member 10 is divided into a corresponding plurality of segments or leaves 13 which are resiliently connected to one another in a serpentine fashion and which impart a resilient behaviour effective in the radial direction to the tool at the different radial distances from the axis of the half-shell, which are shown in the drawing for the individual annular gaps 11. The tool 5 is screwed by means of screws 14 to a tool holder 15 which is connected by means of a pin 16 to the displacement cylinder 4 in a rotationally movable manner. A stop pin 16', embraced by a guide curve 15', cooperates with the tool holder so as to provide the tool 5 with an arrangement, restricted in its path and relatively movable rotationally, on the guide arm 3. This relative mobility is also provided with respect to a honing belt 17 which is guided past the half-shell 9 or bearing portion for precision machining the crank pin 1 and is pressed against the crank pin 1 by the force of the displacement cylinder 4 acting in the direction of the arrow 8. Two ball bearings 18 are further arranged on the guide arm 3 in order to guide the honing belt 17; they promote the curvature of the honing belt 17, intended by the tool 5, to embrace the crank pin 1 at an angle of approximately 150° for the entire duration of a respective precision machining operation.

When the precision machining is carried out with a honing belt, the contact surface of the half-shell 9, which is prominent to support the honing belt, should be precision machined. Alternatively, it is also possible for the precision machining to be carried out not with a honing belt but directly with the tool 5. The surface of the half-shell 9 then provided for a direct contact on the associated crank pin 1, would then merely have to be coated with a mechanically resistant material, such as diamond, borazon, or a ceramic material, which would act as a honing tool. In this connection, the "breathing" design of the tool 5 achieved with the segments 13 connected resiliently to one another also promotes a machining, transmitted as true to shape as possible with respect to the master shafts, of the crank pin associated in each case so that a correspondingly optimum bearing portion for the individual crankshaft bearing is achieved for the workpiece as a whole. The bearing surface is increased due to the plurality of radially resilient forces imparted by the tool along a larger number of peripheral locations of the crank pin. It is also to be understood that the elasticity of the half-shell 9 obtained with the dimensions of the segments 13 in relation to the dimensions of the annular gaps 11 can also be achieved with a plurality of springs, by which a half-shell which is therefore made rigid is supported on the tool holder 15 or on the displacement cylinder 4.

What is claimed is:

1. A tool guide arm apparatus for precision machining of a crank pin of a crankshaft, said apparatus being supported for synchronous movement with the axis of such crank pin but with little or no relative rotation about the pin axis, said apparatus comprising:

(a) a guide arm having means to apply a pressure medium;

(b) a tool holder carried by said guide arm and displaceable radially, with respect to the axis of said crank pin, when acted upon by said pressure medium; and (c) a tool supported by said holder to engage said crank pin, said tool having a bearing portion adapted to bear against an arcuate side of said crank pin, said portion being (i) resilient to the displacement force of said holder, (ii) extending resiliently over an arc of said crank pin of 135°–180°, and (iii) constructed of superimposed leaves of spring steel extending concentrically about the axis of the crank pin, separated from each other by an arcuate gap, and connected resiliently to each other.

2. The apparatus as in claim 1, in which said arcuate gaps are mutually overlapping in a radial direction of said crank pin.

3. The apparatus as in claim 2, in which said gaps have a uniform radial width of about 0.5 mm.

4. The apparatus as in claim 1, in which said leaves are resiliently connected at alternating ends to define a plurality of serpentine connected leaves.

5. The apparatus as in claim 4, in which there are up to three leaves, each at different radial locations with respect to the axis of said crank pin.

6. An apparatus according to claim 1, characterized in that the arcuate gaps (11) are made mutually overlapping in the peripheral direction.

7. An apparatus for precision machining the crank pins of crankshafts by means of non-rotating tools which for contact on one side during the machining of the crank pins of a respective workpiece are mounted, so as to be displaceable in each case radially to the associated crank pin by means of a displacement cylinder acted upon by pressure medium, on a guide arm which is guided in a duplicated manner by two master shafts of the apparatus which are arranged axially parallel to the workpiece and are driven synchronously, characterized in that one bearing part of each tool (5) is formed by a half-shell (9) which is constructed resiliently or supported resiliently with respect to the force of the associated displacement cylinder (4) and which embraces the associated crank pin (1) at an angle of 135° to 180°, the half-shell (9) being constructed integrally with a dimensionally stable base member (10) of spring steel and is divided by at least one annular gap (11) extending concentrically to the axis of the half-shell into two segments (13) connected resiliently to each other, the base member (10) being provided for a connection, in particular a rotationally movable connection, of the half-shell (9) to the displacement cylinder (4).

8. An apparatus according to claim 7, characterized in that the half-shell (9) is divided into a corresponding number of segments (13) by a plurality of annular gaps (11) which extend in up to three different radial distances from the axis of the half-shell.

9. An apparatus according to claim 7, characterized in that each annular gap (11) is wire-eroded with a radial width of approximately 0.5 mm.

* * * * *